US006467637B2

(12) United States Patent
Riga

(10) Patent No.: US 6,467,637 B2
(45) Date of Patent: Oct. 22, 2002

(54) DEATH CARE MERCHANDISING SYSTEM

(75) Inventor: Dennis J. Riga, New Albany, OH (US)

(73) Assignee: The York Group, Inc., Houston, TX (US)

( * ) Notice: Subject to any disclaimer, the term of this patent is extended or adjusted under 35 U.S.C. 154(b) by 0 days.

(21) Appl. No.: 09/769,781

(22) Filed: Jan. 26, 2001

(65) Prior Publication Data

US 2001/0042727 A1 Nov. 22, 2001

Related U.S. Application Data

(60) Provisional application No. 60/178,323, filed on Jan. 27, 2000.

(51) Int. Cl.[7] ..... A47G 29/02; A47F 5/08

(52) U.S. Cl. ..... 211/94.01; 211/85.16; 211/85.27

(58) Field of Search ..... 211/85.16, 85.27, 211/94.01

(56) References Cited

U.S. PATENT DOCUMENTS 5,901,862 A * 5/1999 Riga et al. ..... 211/85.16
D428,289 S * 7/2000 Bachman et al. ..... D6/570
6,276,034 B1 * 8/2001 Bachman et al. ..... 211/85.16 X

* cited by examiner

*Primary Examiner*—Daniel P. Stodola
*Assistant Examiner*—Erica B. Harris
(74) *Attorney, Agent, or Firm*—Stevens, Davis, Miller & Mosher, L.L.P.

(57) ABSTRACT

The present invention includes a method for fabricating, and installing, a death care merchandising system and a method for displaying death care merchandise and a death care merchandising display system having low cost of fabrication in addition to ease of installation at the site of use. The death care merchandising system includes a slat wall, attached to a structural wall and vertically aligned or plumbed. From the slat wall, all further components may be hung. A provision of dividers can be used to delineate merchandise or categories of merchandise displayed within such merchandise display system and accessories, such as cornices, lighting, placards, shelving, retractable and extensible drawers, doors, and other sub units, such as cabinets, may be used in conjunction with the invention.

16 Claims, 13 Drawing Sheets

DEATH CARE MERCHANDISING SYSTEM

This application is a U.S. Non-Provisional Application based on U.S. Provisional Application Ser. No. 60/178,323, filed Jan. 27, 2000, incorporated herein by reference.

BACKGROUND OF THE INVENTION

1. Field of the Invention

The invention relates to a method and article of manufacture for displaying and merchandising death care products. Among such products are caskets, coffins, urns, keepsakes, memorials, such as those made of bronze, marble, granite and other metals, metal alloys, stone or concrete; flowers, vases, stationary, cards, and other printed materials, video tapes and disks, burial vaults and related merchandise for the death care industry.

2. Description of the Related Art

As disclosed in U.S. Pat. No. 5,405,017, entitled "Modular Casket Display System" an alcove was formed of a back wall and two side or wing walls to display full sized caskets. In such a display, neither the back or wing walls were load bearing, but merely formed an alcove in which a double tiered, self-supporting casket display rack was placed within the alcove for displaying a full size casket.

Fundamental to all of the configurations in the modular casket display system of U.S. Pat. No. 5,405,017, was the prefabrication of modular walls that are removably attached to one another to create the desired alcove configurations. As disclosed in such patent, a complete casket display room took three to five days to set up. This is because each of the wing or side walls had to be removably secured to the back wall and each wing wall leveled (such as by the use of leveling screws, such as were conventionally used on refrigerators and the like). Thereafter, prefabricated molding had to be slid into place to conceal the leveling screws. Such a process was labor intensive, both in fabrication of the wing walls so as to be removably attached to the rear wall, as well as in the labor required to install the alcoves at the site of use.

Although other imitations of the alcove structure as shown in U.S. Pat. No. 5,405,017 have appeared on the market, all such systems rely on the structure of a back wall and wing walls, where the wing walls support the rear wall. Thus, all the commercially available systems suffer from the same drawbacks of that of U.S. Pat. No. 5,405,017.

OBJECTS AND SUMMARY OF THE INVENTION

It is, therefore, an object of the present invention to provide methods of merchandising and merchandising display systems which do not suffer from the drawbacks of the prior art.

It is a further object of the invention to provide death care merchandising systems that are less labor intensive to fabricate and assemble than prior art systems and methods of assembling the same.

It is a further object of the invention to provide death care merchandising systems that provide an integrated display, not only of decedent confinement chambers (e.g., burial vaults, urns, caskets or coffins, preferably in sectional, facade or miniature format), but also in conjunction with other death care merchandise including, but not limited to, keepsakes, flower arrangements, stationary, cards, pamphlets, books, grief counselling and other printed matters and electronically stored information (e.g., CD, DVD, audio or videotape) associated with the death care industry, vases, memorials and memorabilia including, but not limited to, bronzes, marble, granite, and other metal, metal alloy, stone and concrete memorials, informational materials, including printed matter such as placards, photographs, and other information about the death care merchandise and the available product and services from the death care industry. The death care merchandising system of the present invention may be embellished by the use of cornices, retractable and extendible drawers to display adornments or interiors for the caskets, coffins, and other death care merchandise, and may be partially or completely provided with doors so as to conceal the contents of various portions of the death care merchandise, e.g., to conceal clothing, infant caskets or coffins or to act as a storage unit for other death care merchandise.

These and other objects of the invention will become apparent when read in conjunction with the detailed description of the preferred embodiments and the appended drawings.

DETAILED DESCRIPTION OF THE PREFERRED EMBODIMENTS

Figure 1:
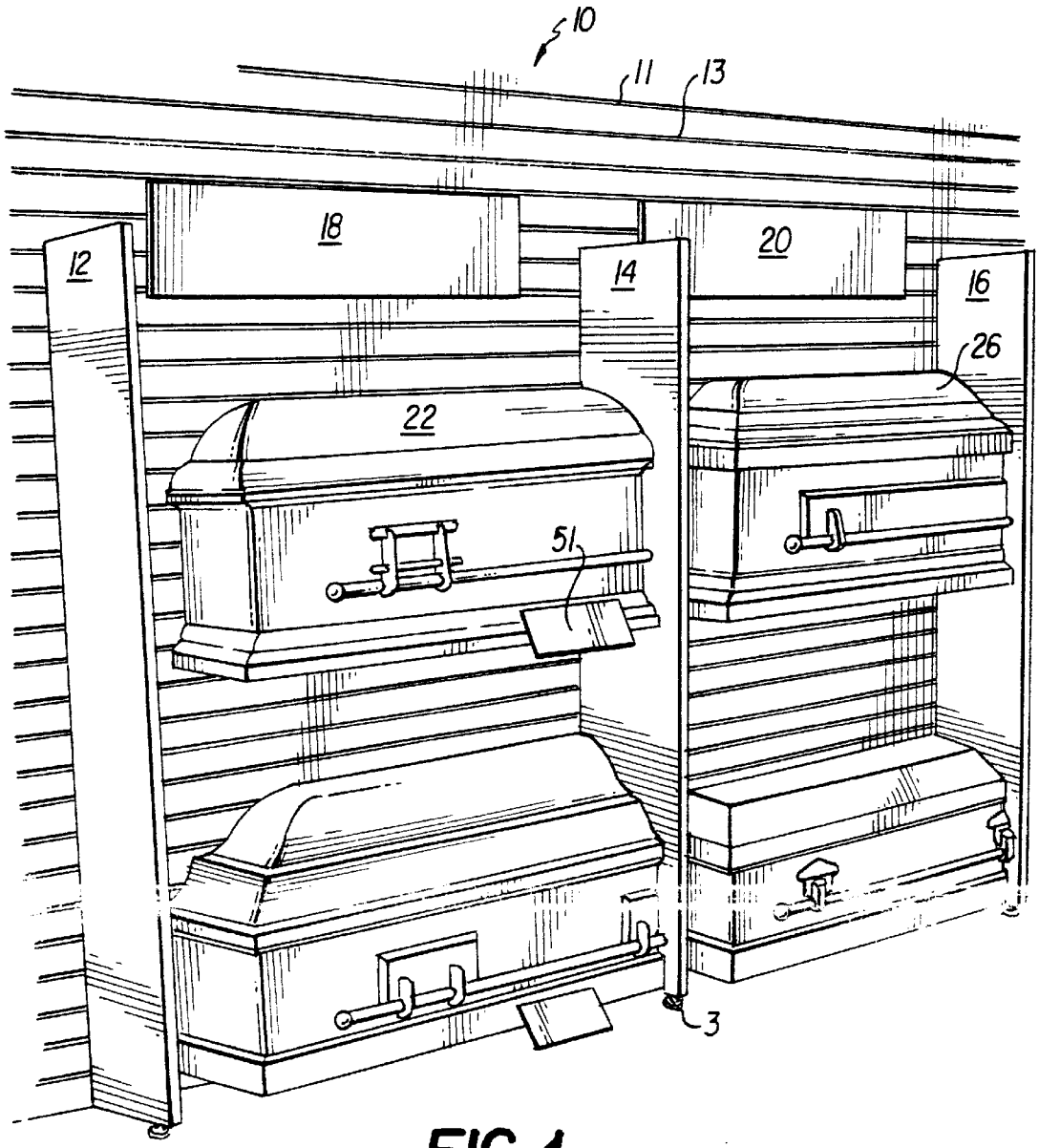
FIG. 1 is a photograph in perspective view of a first embodiment of a death care merchandising system according to the present invention.

FIG. 1 shows a first embodiment of the death care merchandising system according to the present invention.

Figure 2:
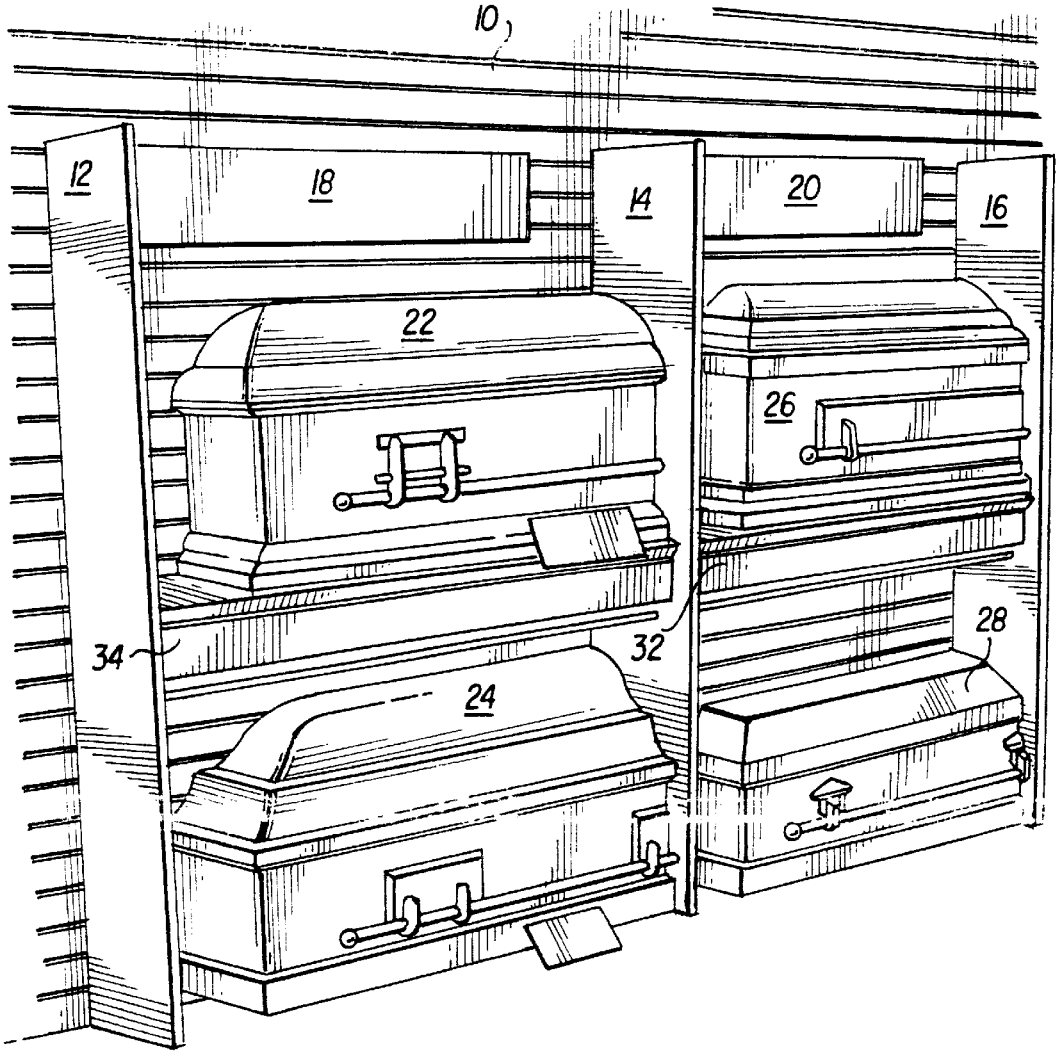
FIG. 2 is a photograph also in perspective view of a second embodiment of the present invention, including a shelf and retractable and extensible drawer.
Figure 3:
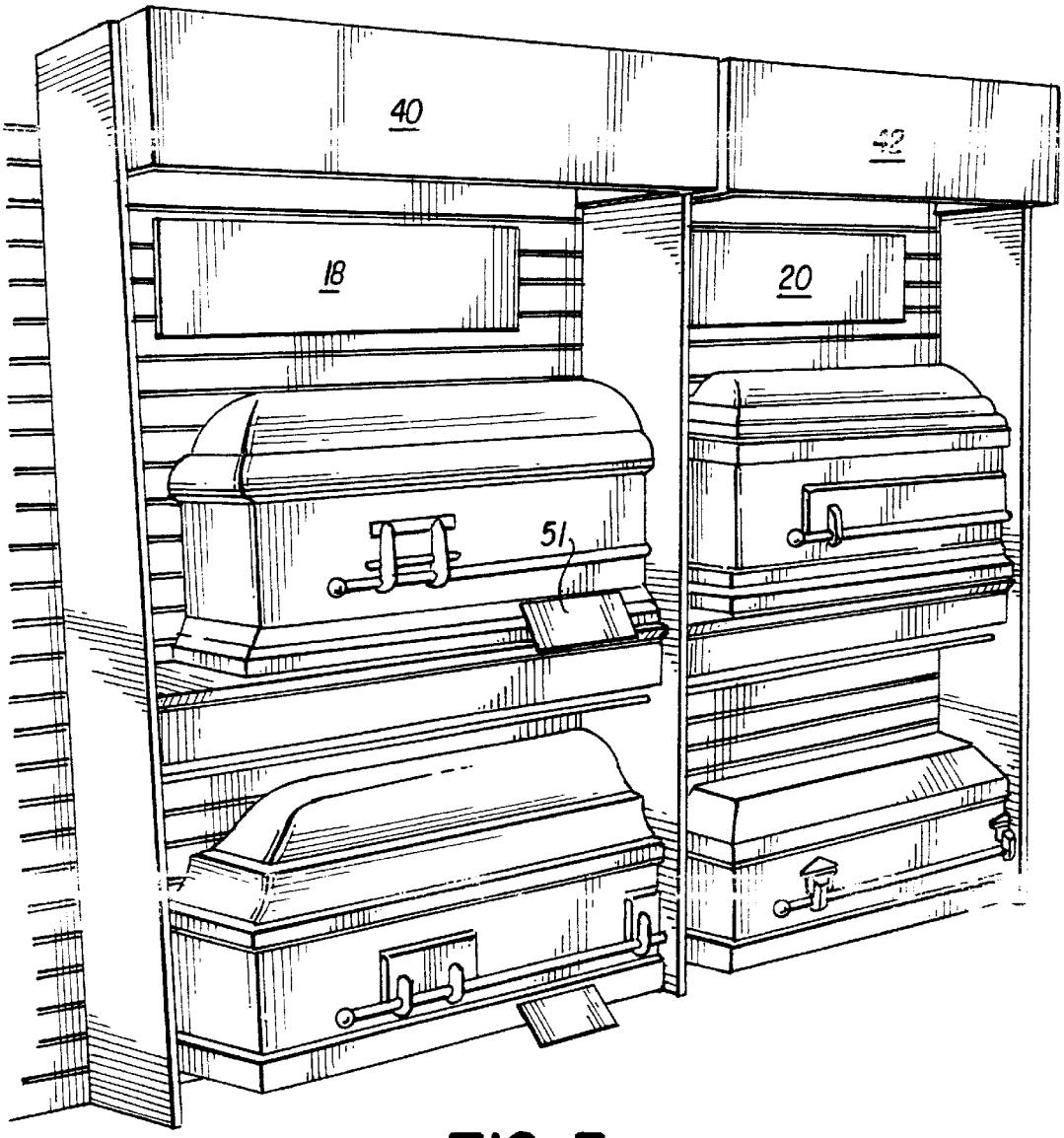
FIG. 3 is a photograph of a third embodiment of the invention similar to that of FIG. 2, but including a cornice and lighting system.
Figure 4:
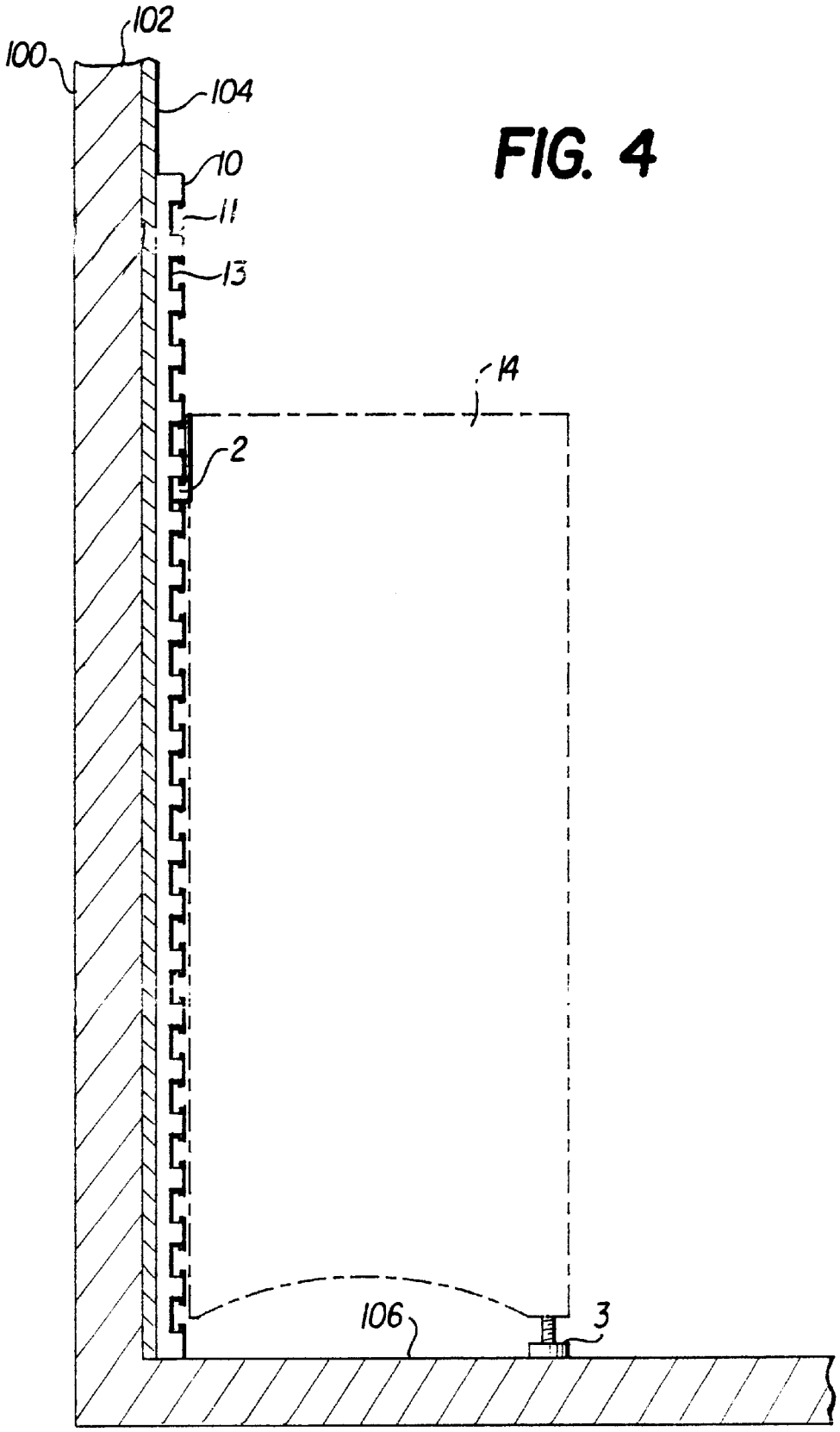
FIG. 4 is a schematic side view of FIG. 1.
Figure 5:
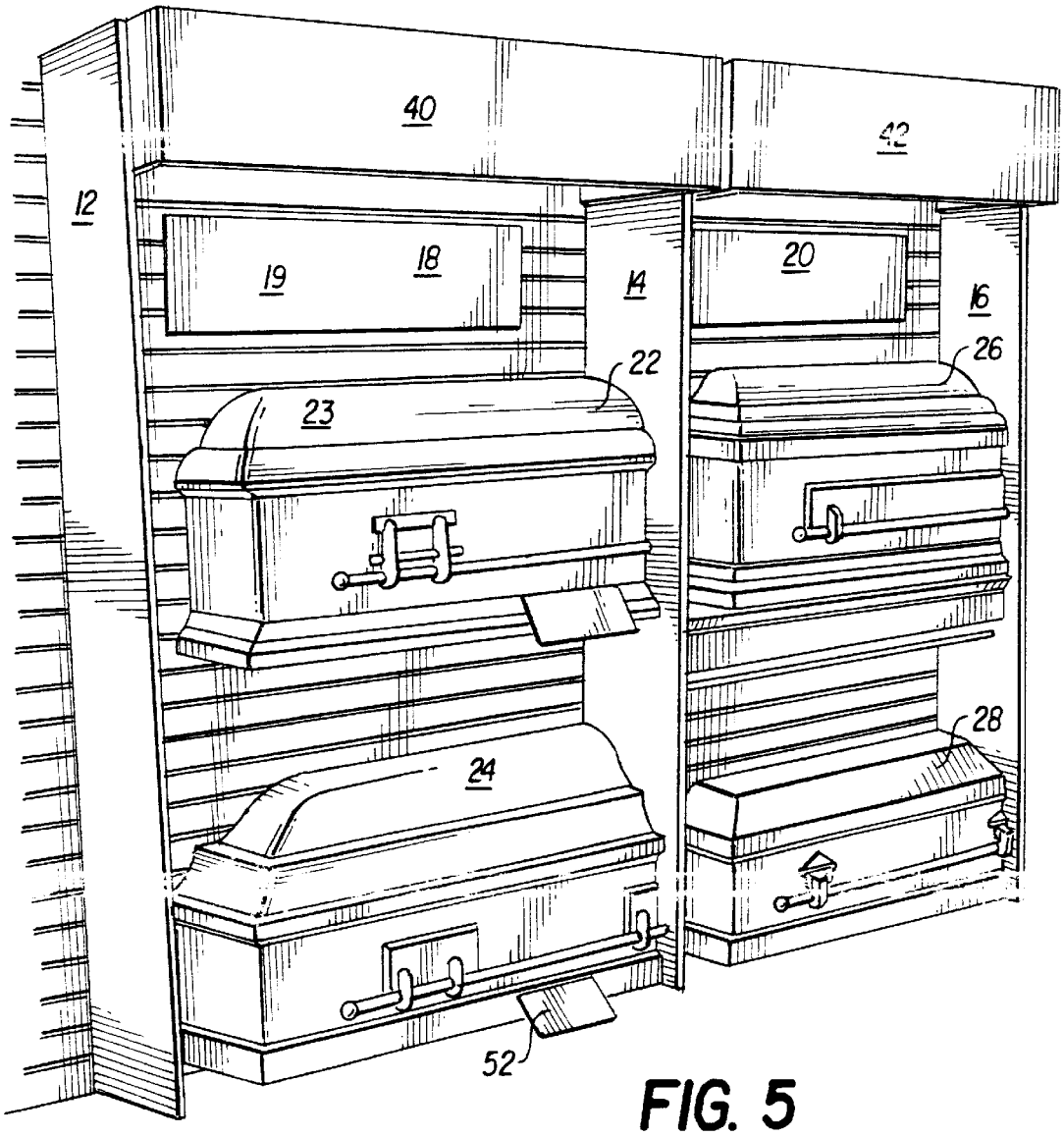
FIG. 5 is a photographic in perspective of a fourth embodiment of the present invention similar to that of FIG. 3, but eliminating the shelf and retractable drawer on the left side of the death care merchandising system.
Figure 6:
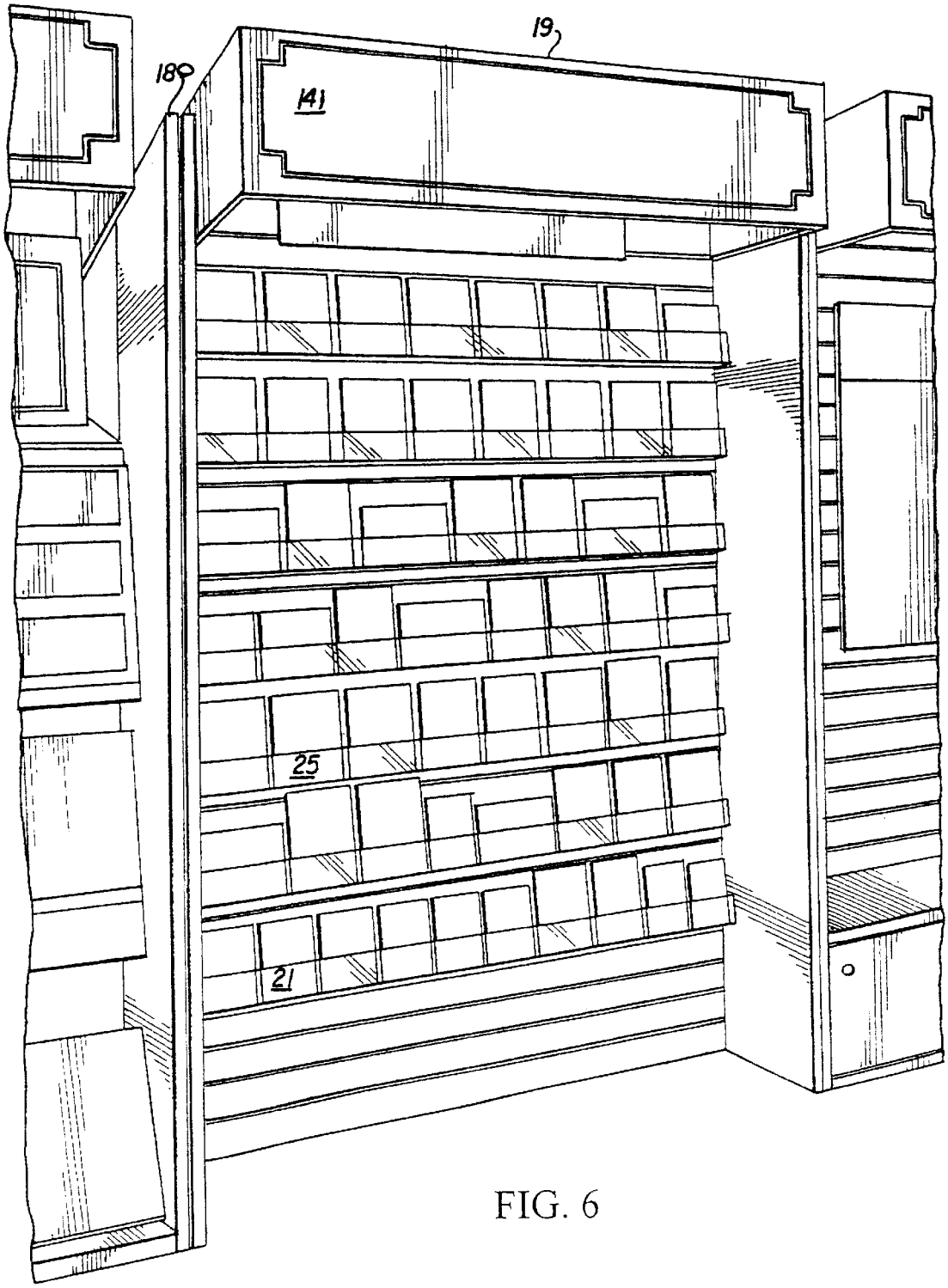
FIGS. 6 and 7 are schematic representations of a plurality of slat walls displaying various death care related merchandise, including printed matter in the form of books, pamphlets and stationary and sympathy cards.
Figure 7:
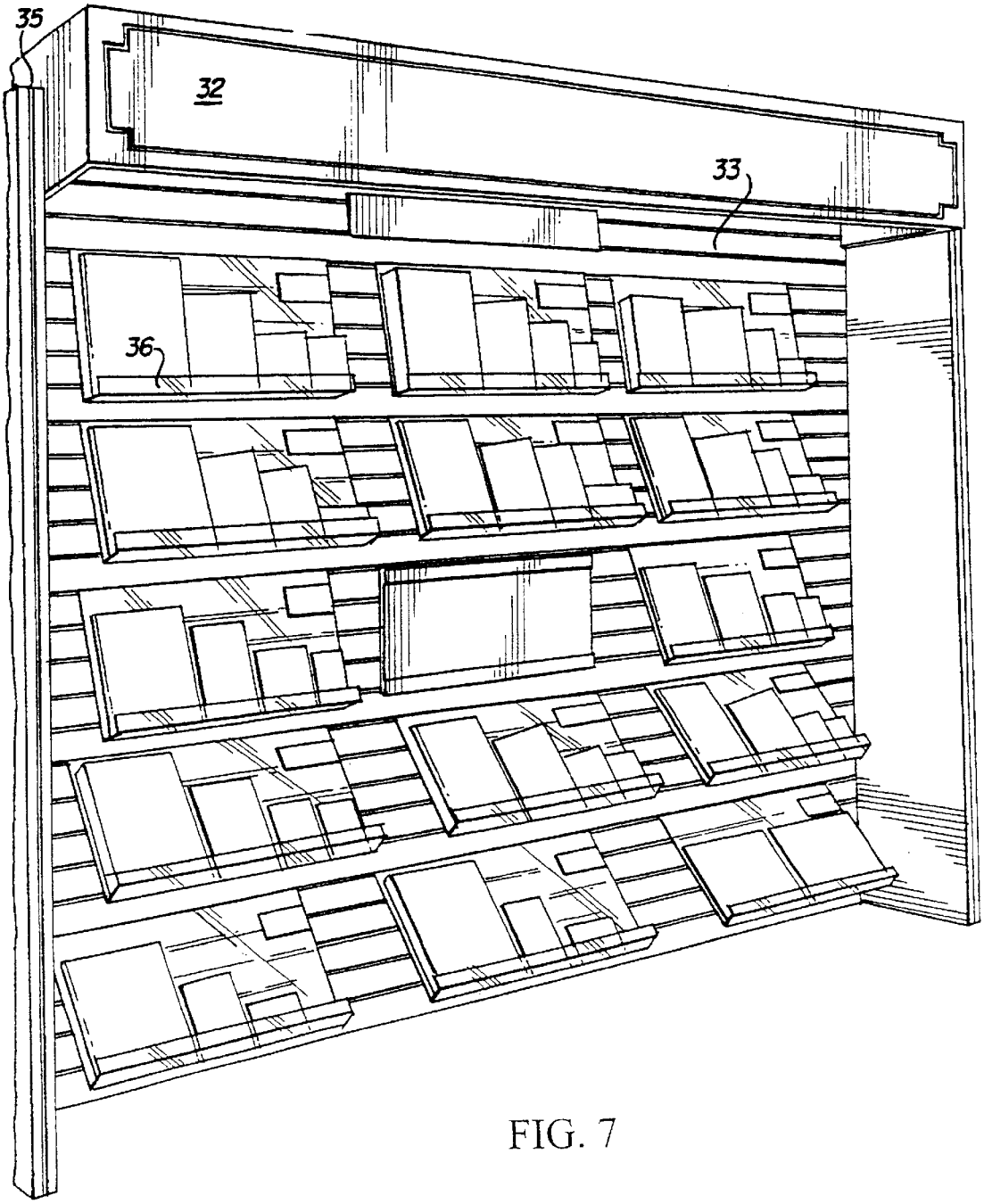
Figure 8A:
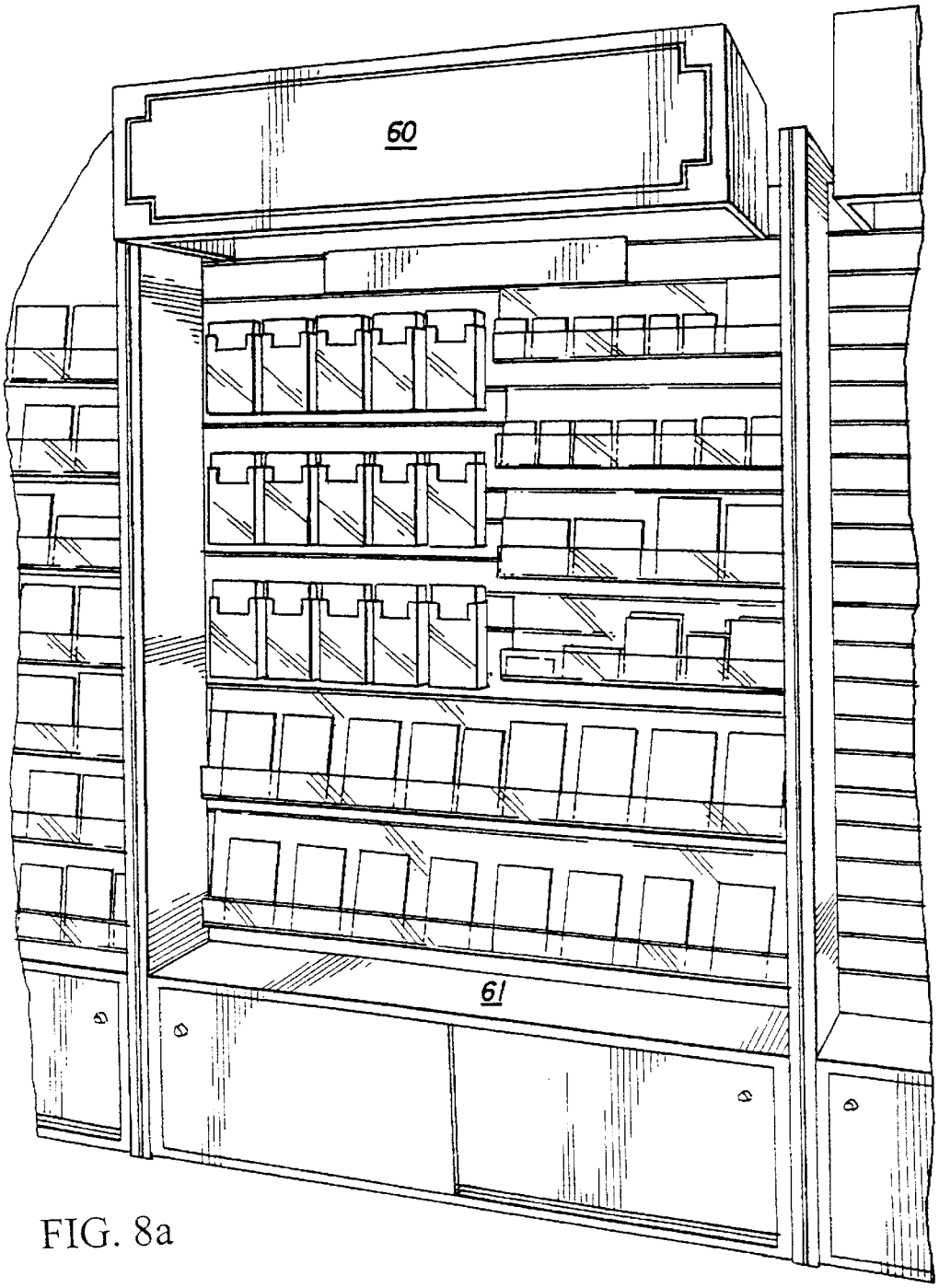
FIGS. 8*a* an 8*b* are schematic representations of slat wall display systems according to the invention including both shelving for displaying death care related merchandise and a cornice and cabinet.
Figure 8B:
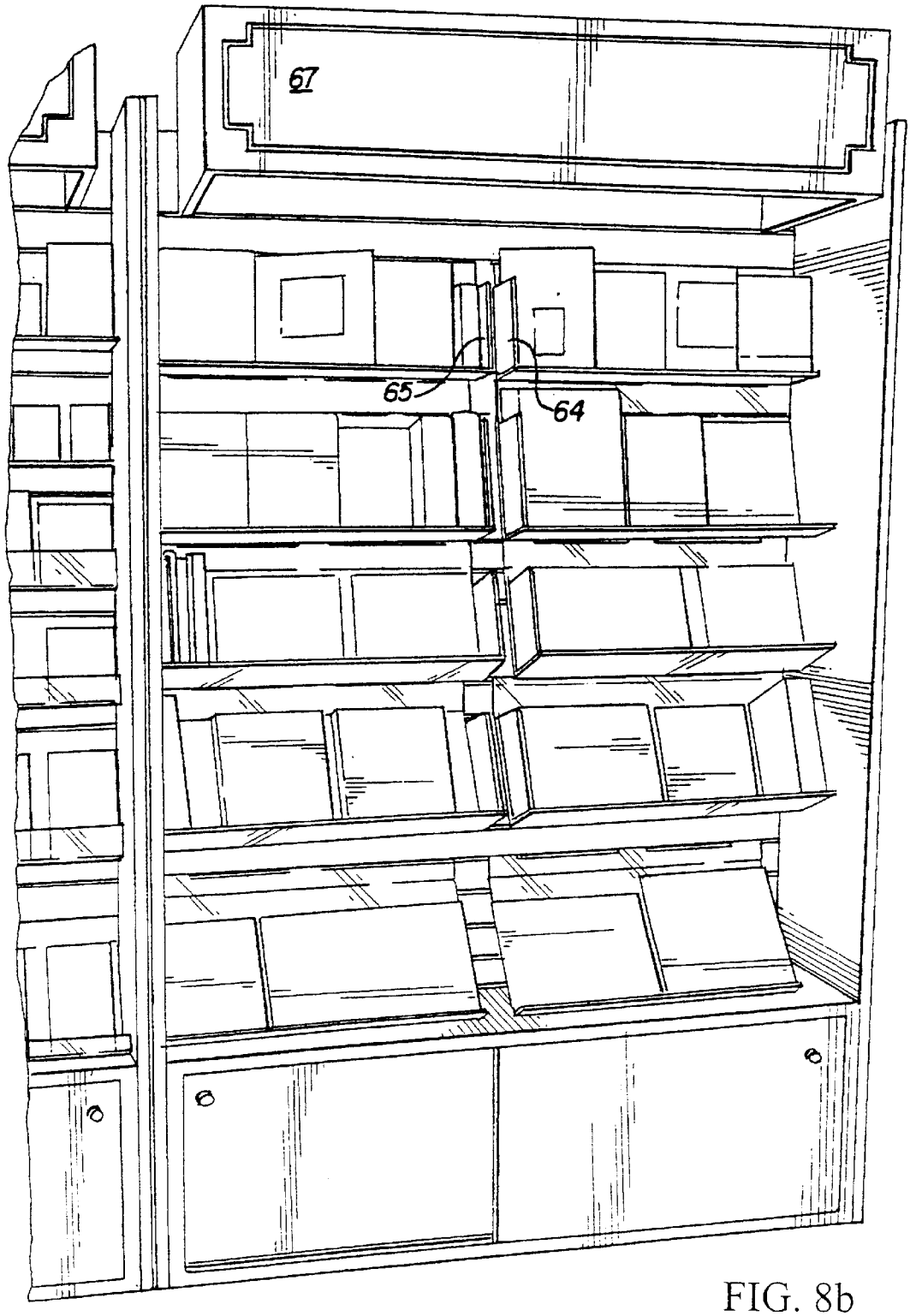
Figure 9:
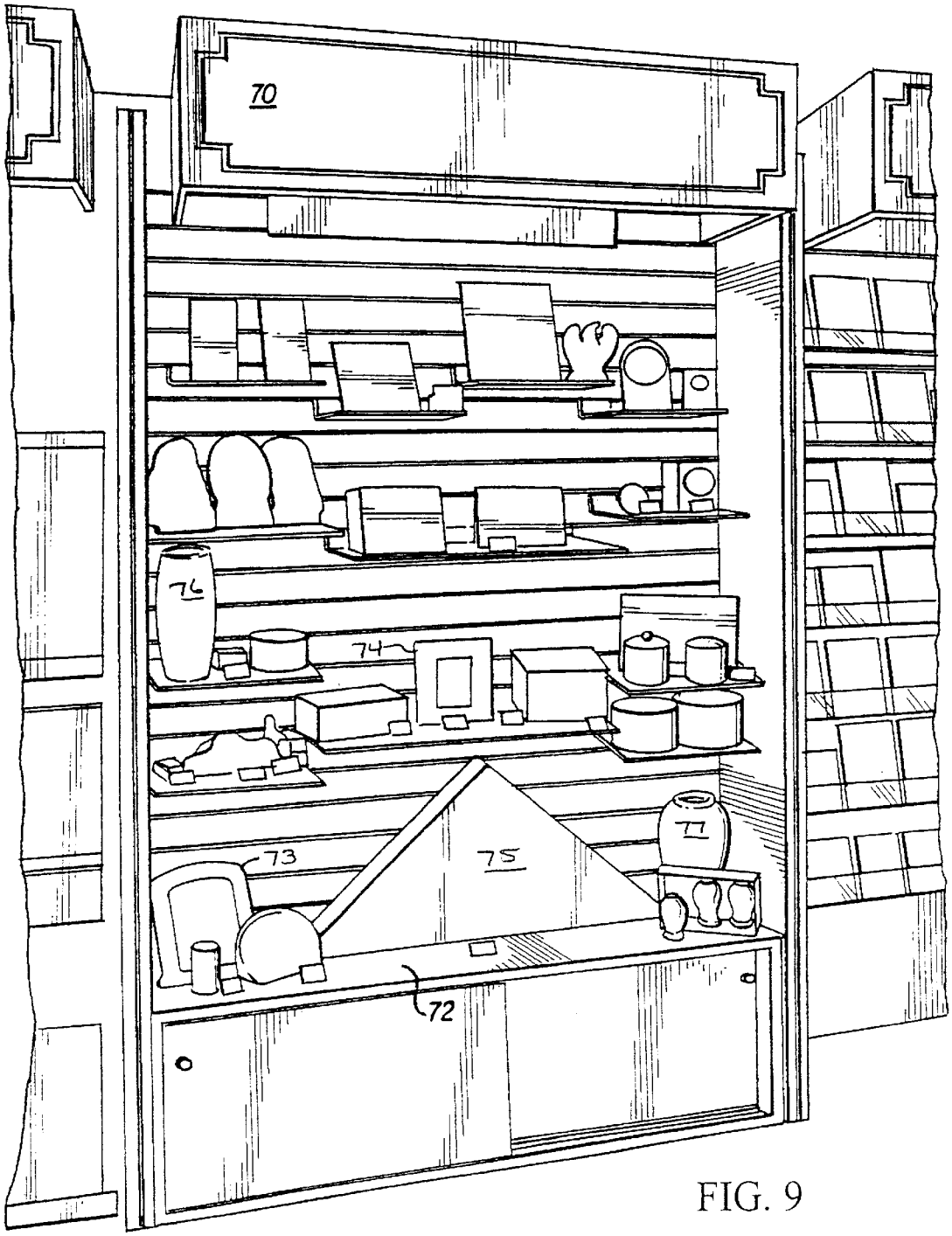
FIG. 9 is a schematic representation of a slat wall death care merchandising system including shelves for displaying death care related merchandise including urns, vases, memorabilia, picture frames, keepsakes and other memorabilia.
Figure 10A:
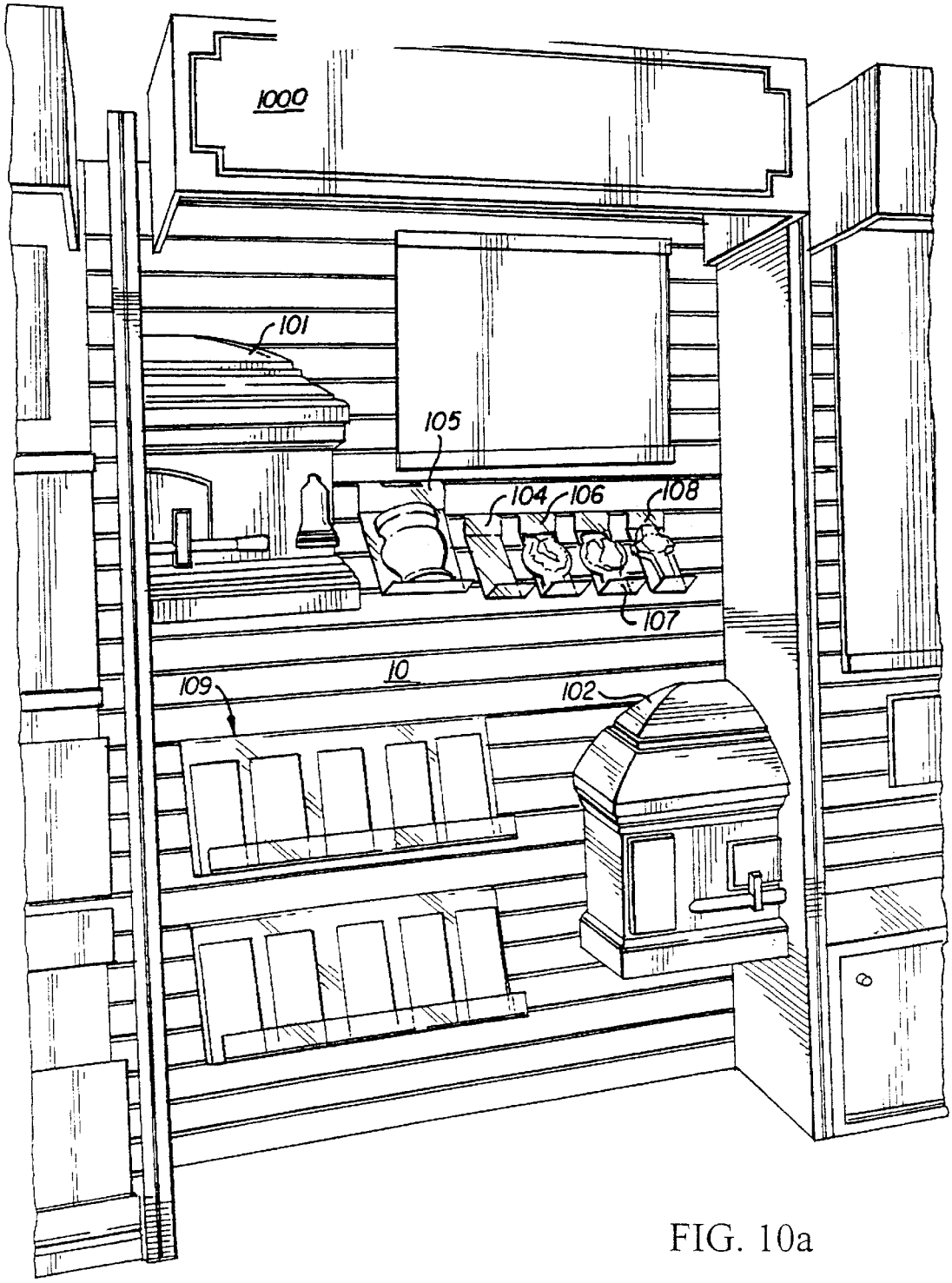
FIGS. 10*a* are 10*b* schematic representations of a slat wall death care merchandising system including the display of sectional caskets and ornamentation therefore, pamphlets and other printed matter within a single slat wall display.
Figure 10B:
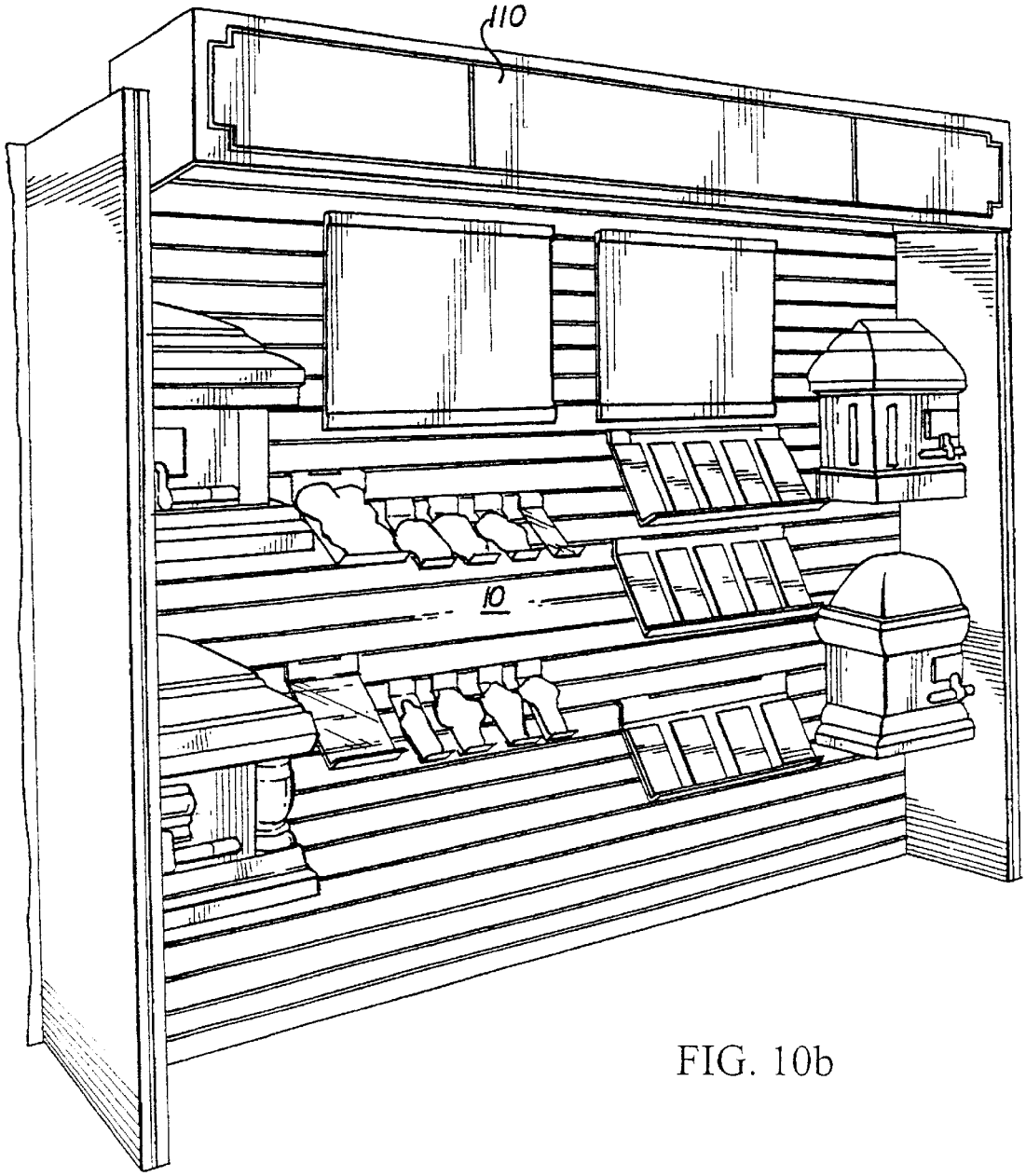
Figure 11:
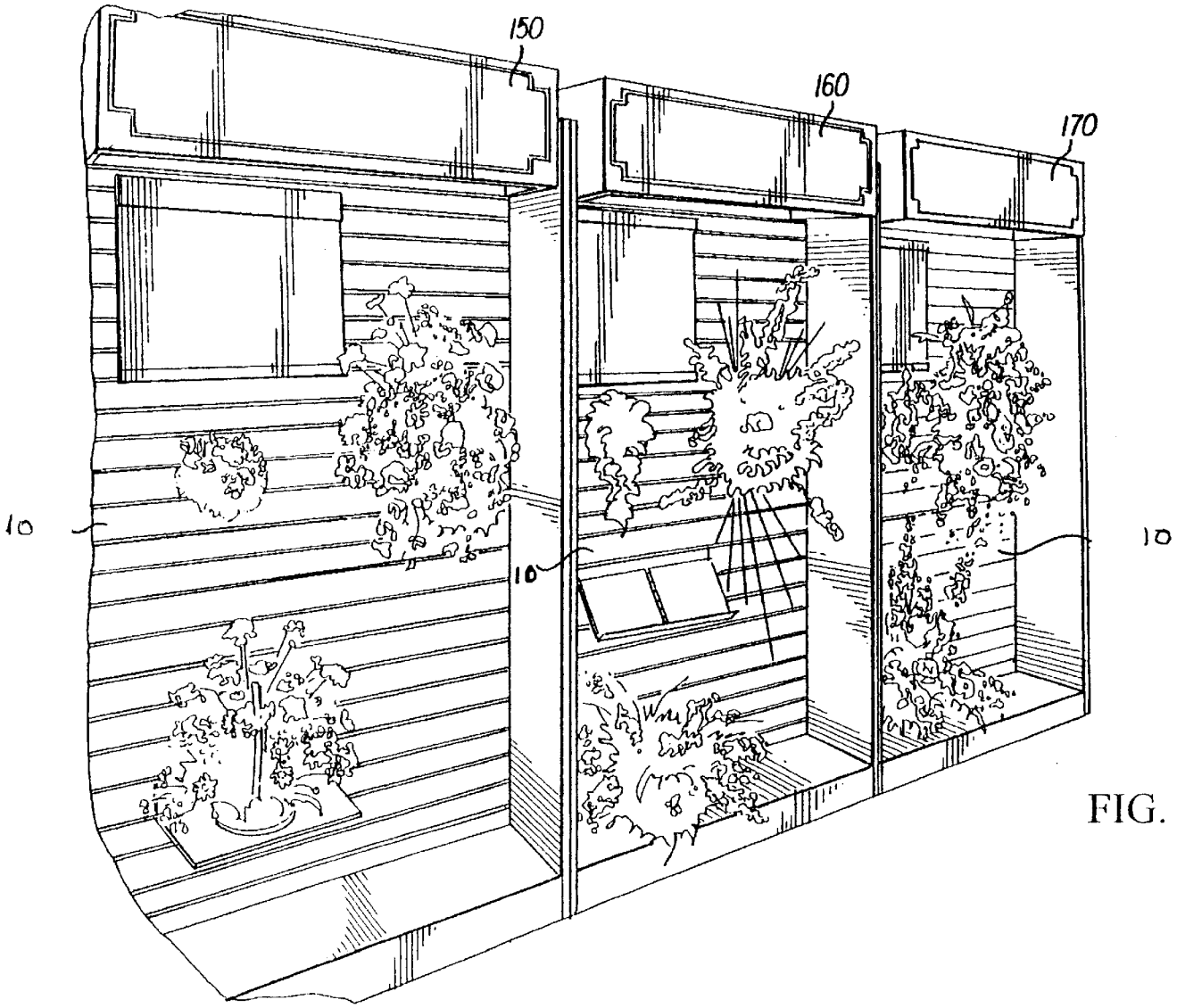
FIG. 11 is a schematic representation of a plurality of slat wall displays for exhibiting floral arrangements.

In such death care merchandising system, a slat wall, generally illustrated at 10 is attached directly to a structural wall 100 (FIG. 4). When structural wall 100 is made of dimension lumber 102, optionally having a facing layer 104, the slat wall can be directly attached by means of any suitable fasteners (not shown). The facing layer 104 may comprise plasterboard, paneling, plywood, particle board or other similar materials. The fasteners used may comprise nails, screws, or other similar materials, which will be inserted directly into dimension lumber 102. These fasteners may be used in conjunction with an adhesive on the back of slat wall 10 so as to increase its adhesion to facing layer 104 (or, alternatively, directly to dimension lumber 102). When the structural wall 100 is formed of masonry, such as brick, block or concrete, the use of an adhesive is a desirable option. Shims, spacers or other similar means to plumb slat wall 10 to a vertical orientation can be utilized in manners known, per se. Preferably, slat wall 10 is positioned directly to grade with floor 106, which may be formed of conventional materials, including concrete, wood, etc. It should be understood that both structural wall 100 and floor 106 will exist at the site of installation or, alternatively, may be newly erected or refurbished as required. Referring again to FIG. 1, slat wall 10 can become the sole load bearing support for all further elements to be described. For example, dividers 12, 14, 16, 35 and 180 are each supported by slat wall 10. Although dividers 12, 14, 16, 35 and 180 have a vertical orientation, they are not "wing walls" such as found in the prior art. They need not be positioned at the end edges of slat wall 10 nor are they necessary to support slat wall 10. Rather, the support for slat wall 10 comprises its adherence either through an adhesive, fasteners and/or both to a structural wall 100. The dividers 12, 14, 16, 35 and 180 may be included (or omitted) and merely delineate the category, area or type of death care merchandise being displayed. For example, referring again to FIG. 1, placard 18 may be positioned in the space delineated between dividers 12 and 14 so as to provide information, such as materials of construction, e.g., wood or metal caskets, appearing between the dividers 12, 14. Placard 20 can provide the same or dissimilar information for the merchandise displayed between dividers 14 and 16. As shown in FIG. 1, four sectional caskets 22, 24, 26, 28 are displayed and the sectional caskets may be attached directly to slat wall 10 by means of a French cleat, "J"-hooks or other fasteners. Placard 141 (FIG. 6) may also be placed on the cornice if the cornice is provided as discussed below. Alternatively, as shown in FIG. 2, shelves 30, 32 may be provided to support sectional caskets (in all drawings, similar numbers have been used to denote similar elements). In addition to shelves 30, 32, extensible and retractable drawers 34, 36 may be provided to display the interior linings of the caskets (also known as adornments). However, as shown in FIG. 5, it is not necessary that each of the spaces delineated between dividers 12 and 14 mirror the adjacent space as between dividers 14 and 16. Thus, in FIG. 5, both shelf 30 and drawer 34 are omitted, though shelf 32 and drawer 36 are provided in the adjacent space. Also, as shown in FIG. 5 (as well as FIG. 3), the death care merchandising system according to the present invention may be further upgraded by the provision of cornices 40, 42, 60, 67, 70, 110, 150, 160, 170, 1000. Cornices, when provided, may be attached to slat wall 10 and optionally to each other and to dividers 12, 14, 16. Such cornices may also contain placards 141 (FIG. 6) as well as an illumination source so as to direct illumination on objects within the death care merchandise display system. Such illumination preferably takes the form of high intensity incandescent lamps. Thus, in each of FIGS. 3 and 5, the illumination is directed both toward placard 18 at 19 and casket 22 at 23. Lighting intensity, color, and positioning may be varied to bring out the most aesthetic features of the merchandise being displayed or to highlight educational or informative information. For example, as shown in each of the figures, an information holder 21, 25, 36, 50, 52, 64, 65 and 102 can be provided so as to receive educational or informative printed matter, photographs, or other information, such as pricing, on card 51 (FIGS. 1, 3). Slat wall 10, which comprises a plurality of grooves 11, 13, can also receive hangers such as "J"-hooks or shelving formed of metal or polymeric material to display other death care merchandise, e.g., memorials or memorabilia (75), stationary, vases (76–77), miniatures of burial vaults, printed matter, stationary, cards, books, pamphlets, audio and/or video tapes and discs, flower arrangements, further adornments, including decorative casket edges, handles and other hardware (105–108), religious, fraternal or other decorations and adornments, picture frames (73–74), photographs, instructional or educational materials, pricing information and other death care related merchandise or information. See, generally, FIGS. 6, 7, 8*a*–8*b*, 9, 10*a*–10*b* and 11.

It will, thus, be readily apparent that fabrication of the death care merchandising system according to the present invention is less labor intensive, both in fabrication of the components, as well as in the time of workman in erecting the system at its site of exhibition. Slat wall 10 is made of commercially available sheets in a variety of configurations having different distances between the slots 11, 13 in slat wall 10. The slat wall may be used in its natural state or may be coated, e.g., by painting, to accent or compliment the merchandise being displayed. A preferred coating is a variegated coating, such as a liquid which carries beads of different color that splatter when sprayed on a surface to impart to the surface a neutral hue that either accents or compliments the death care merchandise placed next to the finish. Although I have disclosed that the slat wall 10 carries the principal weight of all components placed on the slat wall, it is also possible to use dividers 12, 14, 16, to bear some of the weight of the components. Thus, shown in FIG. 1 is shown a support 8, forming part of a French cleat, that can support the display units 7, 9 which display units 7, 9 can hold adornment materials (casket interiors). Alternatively, cleat component 8 and its opposing component (not shown) on divider 14 can support an extensible drawer 36.

In addition, I have found that a simple way to install dividers 12, 14, 16, on slat wall 10 is to attach a reversed "J" hook 2 (FIG. 4) to a rear surface of a divider, e.g., 14, and then force such "J" hook 2 upward in the direction of the arrow by use of an adjustable foot 3 (FIGS. 1, 4), which lifts the divider 14 placing the divider 14 in a state of compression. Unlike the wing walls of the prior art, which had to be leveled, the purpose of foot 3 is merely to apply upward lift to place the divider in compression.

Although I have described various death care merchandise for use in connection with the death care merchandising system of the invention, other shelving, cabinets and configurations, such as shown in my application Ser. No. 60/162,149, filed Oct. 29, 1999 and application Ser. No. 09/698,474, filed Oct. 30, 2000 (the entire disclosures of which is herein incorporated by reference), may be employed.

The merchandising system of the invention may be used in conjunction with other modules, such as those shown in U.S. Pat. No. 5,901,662 or as a separate merchandising system. When used as a separate merchandising system, it may include a door or doors between the dividers to conceal the contents of the display unit, e.g., infant caskets, until such merchandise is to be viewed.

I claim:

1. A death care merchandising system comprising a slat wall, said slat wall comprising a plurality of slats, said slats being spaced from one another to define a plurality of slots between said slats, said slat wall being directly fastened to a load bearing wall, said slats being fitted with at least one attachment to display death care merchandise selected from the group consisting of facades, sectional, and miniatures, of a decedent confinement chamber, said decedent confinement chamber being selected from the group consisting of coffins, caskets, urns and vaults; at least one non-load bearing divider, said divider extending in a vertical orientation on said slat wall wherein said vertical divider comprises a reversed "J" hook, which "J" hook is forced upwardly into at least one of said slots by an adjustable foot at a bottom of said divider.

2. The death care merchandising system of claim 1, wherein said slat wall is fastened to said load bearing wall with a fastener, wherein said fastener constitutes the sole load bearing support for said death care merchandising system.

3. The death care merchandising system of claim 1, wherein said divider is positioned intermediate the right and left sides of said wall.

4. The death care merchandising system of claim 1, further comprising at least one shelf, the weight of which is supported solely by said slat wall.

5. The death care merchandising system of claim 4, wherein said shelf further includes at least one extendible and retractable drawer.

6. The death care merchandising system of claim 1, further comprising a cornice, said cornice being attached to said slat wall at an upper end of said slat wall.

7. The death care merchandising system of claim 6, wherein said cornice further comprises illumination means to illuminate said death care merchandise displayed on said slat wall.

8. The death care merchandising system of claim 1, comprising at least one second slat wall directly fastened to a load bearing wall, said at least one second slat wall also having a plurality of slats spaced from one another to form a plurality of slots, and said slots receiving at least one death care related item selected from the group consisting of floral arrangements, urns, picture frames, photographs, bronzes and other memorial plaques, ornamentation for the decedent confinement chamber, adornments, printed matter, keepsakes, and information in the form of media selected from the group consisting of audio tape, videotape, film, CD, DVD, and other electronic media.

9. The death care merchandising system of claim 8, wherein said printed matter is selected from the group consisting of sympathy cards, books, stationery, pamphlets and keepsakes.

10. The death care merchandising system of claim 8, wherein said printed matter includes information on the death care merchandise being displayed on said death care merchandising system.

11. A method of merchandising death care merchandise, said method comprising fastening a slat wall to a load bearing wall, plumbing said slat wall and attaching to said slat wall at least one death care merchandise selected from the group consisting of sectional, facades and miniatures of a decedent confinement chamber from the group consisting of coffins, caskets, urns and vaults; fastening at least one category delineator to said slat wall wherein said step of fastening includes forcing an inverted "J" hook on said category delineator into one of said slots in said slat wall by forcing the "J" hook upwardly by extending an adjustable foot on a lower end of said category delineator.

12. The method of claim 11, further comprising fastening a plurality of said category delineators to said slat wall.

13. The method of claim 11, further comprising fastening at least one second slat wall to a load bearing wall in proximity to said slat wall and displaying at least one death care related merchandise in said at least second slat wall.

14. The method of claim 13, wherein said death care related merchandise displayed in said at least second slat wall is selected from the group consisting of floral arrangements, printed matter, electronic media, keepsakes, urns, bronzes or other memorial plaques, ornamentation for the decedent confinement chamber, picture frames, photographs and adornments.

15. The method of claim 13, wherein said fastening step includes fastening a plurality of said at least one second slat wall to a structural wall.

16. The method of claim 13, further comprising fastening at least one additional element selected from the group consisting of cornices, shelves, retractable and extendible drawers, doors and cabinets to said slat wall or to said at least one second slat wall.

* * * * *